US005379479A

United States Patent [19]

Nelson

[11] Patent Number: 5,379,479

[45] Date of Patent: Jan. 10, 1995

[54] ADHESIVE SPREADER

[76] Inventor: Jim L. Nelson, 1818 Dogwood, Arlington, Tarrant County, Tex. 76012

[21] Appl. No.: 999,598

[22] Filed: Dec. 31, 1992

[51] Int. Cl.[6] ..... E01C 19/22; E04G 21/10

[52] U.S. Cl. ..... 15/245.1; 15/235.4; 404/97; 404/118

[58] Field of Search ..... 15/235.3, 235.4, 235.5, 15/235.6, 235.7, 235.8, 245.1; 404/97, 118; 425/458; 294/3.5, 19.1

[56] References Cited

U.S. PATENT DOCUMENTS

| | | | |
|---|---|---|---|
| 1,144,891 | 6/1915 | Cannon . | |
| 1,306,135 | 6/1919 | Brickler | 15/235.4 |
| 1,955,101 | 4/1934 | Sloan | 15/235.5 |
| 2,913,753 | 11/1959 | Peterson . | |
| 3,090,066 | 5/1963 | Ferrell, Jr. et al. | 15/235.8 |
| 3,611,470 | 10/1971 | Gaston . | |
| 3,803,662 | 4/1974 | Glejf . | |
| 4,230,356 | 10/1980 | O'Connor | 15/235.3 |
| 4,397,581 | 8/1983 | Jarvis | 15/235.4 |
| 4,723,869 | 2/1988 | Dragich | 15/235.4 |
| 4,822,209 | 4/1989 | Dragich | 404/97 |
| 4,982,470 | 1/1991 | Szabo . | |
| 4,984,324 | 1/1991 | Farris | 15/236.05 |

FOREIGN PATENT DOCUMENTS

| | | | |
|---|---|---|---|
| 1206140 | 9/1964 | Germany | 118/256 |

*Primary Examiner*—David A. Scherbel
*Assistant Examiner*—Tony G. Soohoo
*Attorney, Agent, or Firm*—Felsman, Bradley, Gunter & Dillon

[57] ABSTRACT

A handle attached to a spreader blade housing. The housing supports a spreader blade which spreads the adhesive over a desired surface. The angle of the handle is preferably adjustable relative to the housing. Weights are added to the housing to apply a downward force to the spreader blade, so that a downward force need not be applied through the handle by an operator. The weights are preferably removable, allowing the weight applied to the spreader blade to be adjusted to compensate for different viscosities of adhesive and different application speeds.

5 Claims, 2 Drawing Sheets

ADHESIVE SPREADER

BACKGROUND OF THE INVENTION

1. Field of the Invention

The present invention relates generally to the spreading of adhesive materials, and more specifically to a tool for spreading a layer of adhesive over a surface, such as a floor.

2. Description of the Prior Art

Numerous types of flooring are attached to the underlying subfloor or concrete slab using an adhesive material. The adhesive must be spread evenly over the underlying surface prior to placement of the floor. For example carpets, individual tiles, and roll out flooring material are applied over an adhesive. In addition, many roofing materials can be applied over similar adhesive layers.

The adhesives used for these purposes are typically quite viscous and sticky. They are typically spread by use of a hand trowel. The person spreading the adhesive typically works on their knees, so that application is physically very difficult, and quite slow. At the present time, application of adhesives to large areas is labor intensive, resulting in a relatively high cost of application.

Attempts have been made in the past to improve the tools used to apply the adhesive. These improvements are typically directed to spreaders which allow their use from a standing position. Examples of such tools include U.S. Pat. No. 3,803,662, issued to Glejf, and U.S. Pat. No. 4,982,470, issued to Szabo. Various other designs are also known. Particular units allow the spread of adhesive over the surface by pushing, pulling or moving them back and forth laterally.

All of the units presently available on the market suffer from various drawbacks. Some devices are complex, with various adjustable parts. The adhesive which is used tends to work its way into various small openings, making these devices very difficult to clean. Other devices are extremely awkward to use, or simply are of such a design that they are impossible to use quickly. The spreaders generally available on the market require a steady downward pressure to be applied in order to form a thin layer of adhesive. Such an application technique tends to quickly tire the person spreading the adhesive, and makes it difficult to obtain an even layer of adhesive over a large surface.

With the currently available spreaders, it is very difficult to obtain a thin, even layer of material over a large surface. The problem is exacerbated by the fact that different adhesives have different viscosities, which require more or less downward pressure on the part of the operator. This downward pressure must be applied consistently over the entire course of spreading the adhesive. Because it is difficult to obtain a good spread of adhesive with the currently available spreading tools, many professionals simply revert to using a hand trowel, and spread adhesive over floor surfaces from a kneeling position. In other words, the presently available designs do not adequately solve the problems faced by those in the business of spreading adhesives over a large surface.

It would be desirable to provide a spreader which is easy to use from a standing position. It would be desirable for such a spreader to be simple to manufacture and use, inexpensive, and easy to clean. A superior design would allow thin, even coatings of adhesive to be applied very quickly, and it would be further desirable for such a spreader to be easily adaptable to use with different viscosities of adhesive.

SUMMARY OF THE INVENTION

Therefore, in accordance with the present invention, a spreader for use with adhesives includes a handle attached to a spreader blade housing. The housing supports a spreader blade which spreads the adhesive over a desired surface. The angle of the handle is preferably adjustable relative to the housing. Weights are added to the housing to apply a downward force to the spreader blade, so that a downward force need not be applied through the handle by an operator. The weights are preferably removable, allowing the weight applied to the spreader blade to be adjusted to compensate for different viscosities of adhesive and different application speeds.

BRIEF DESCRIPTION OF THE DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

DESCRIPTION OF THE PREFERRED EMBODIMENT

Figure 1:
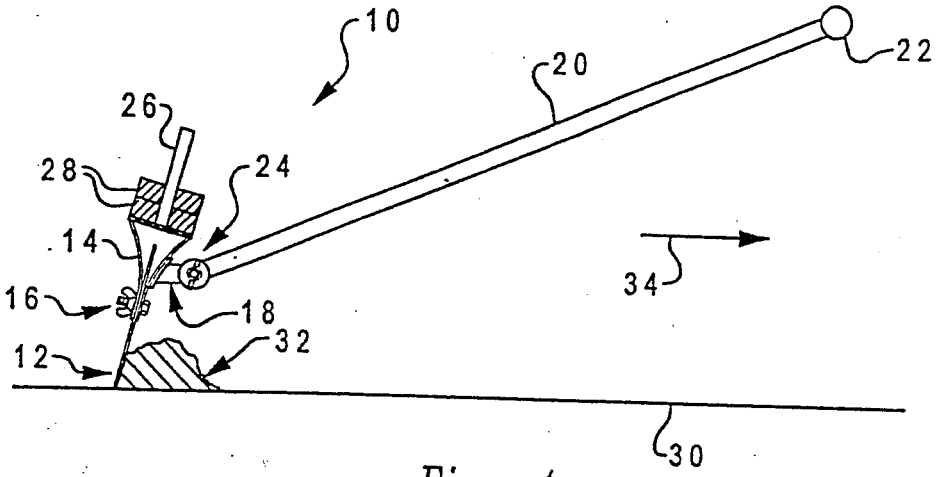
FIG. 1 is a side view of a preferred embodiment of a spreader according to the present invention.

FIG. 1 is a side view of a preferred spreader 10 according to the present invention. The preferred spreader 10 includes a blade 12 attached to a blade housing 14. The blade 12 is preferably attached to the blade housing 14 using a plurality of bolts 16 as will be illustrated in more detail in FIG. 2. A handle mount 18 is attached to the blade housing 14.

A handle 20 is attached to the handle mount 18 and allows the spreader 10 to be pulled by a user. For ease of use, a grip 22 is attached to the far end of the handle 20. In the preferred embodiment, the grip 20 includes a T-bar grip (see FIG. 3), but any suitable handle and grip arrangement can be used. The handle 20 is connected to the handle mount 18 through a connector 24.

Two or more support rods 26 project from the top of the blade housing 14. The support rods 26 provide ease of attachment for removable weights 28. In FIG. 1, two removable weights 28 are shown, although more or less may be used as desired. The number of removable weights 28 is selected to apply the appropriate downward force on the blade 12 to provide for the smooth application of adhesive.

In use, the spreader 10 is used to spread a layer of adhesive over a surface 30 such as a floor or roof. A pile of adhesive 32 is placed on the surface 30, and the spreader 10 is pulled by means of the handle 20 in the direction shown by arrow 34. As shown in FIG. 1, only the lower edge of the blade 12 contacts the surface 30. The adhesive 32 tends to build up in front of the blade 12, with only a thin layer passing underneath the blade 12 to remain on the surface 30. With prior art spreaders, a downward pressure must be applied to the handle. With the present spreader, however, the weight provided by the detachable weights 28 to the blade 12 provides all the downward force necessary. Thus, the operator is required merely to pull the spreader 10 in a horizontal direction in order to obtain the desired layer of adhesive.

The number of weights 28 to be used will be easily determined by the user with only a few seconds of experimentation. For adhesive 32 which is more viscous, more weights 28 will need to be used. The weight to be used will also depend upon the walking speed of the user. In order to be able to move the spreader 10 more quickly in a horizontal direction, a greater weight will need to be applied to the blade 12. If the operator moves more slowly, less weight can be applied. In a typical spreader, each of the weights 28 will weigh between two and five pounds, and between two and six weights will ordinarily be sufficient.

Blade housing 14 includes a planar top portion and two curved side portions. The side portions curve in toward the blade, which is placed between them and attached by means of bolts 16. This is shown in more detail in FIG. 2.

Figure 2:
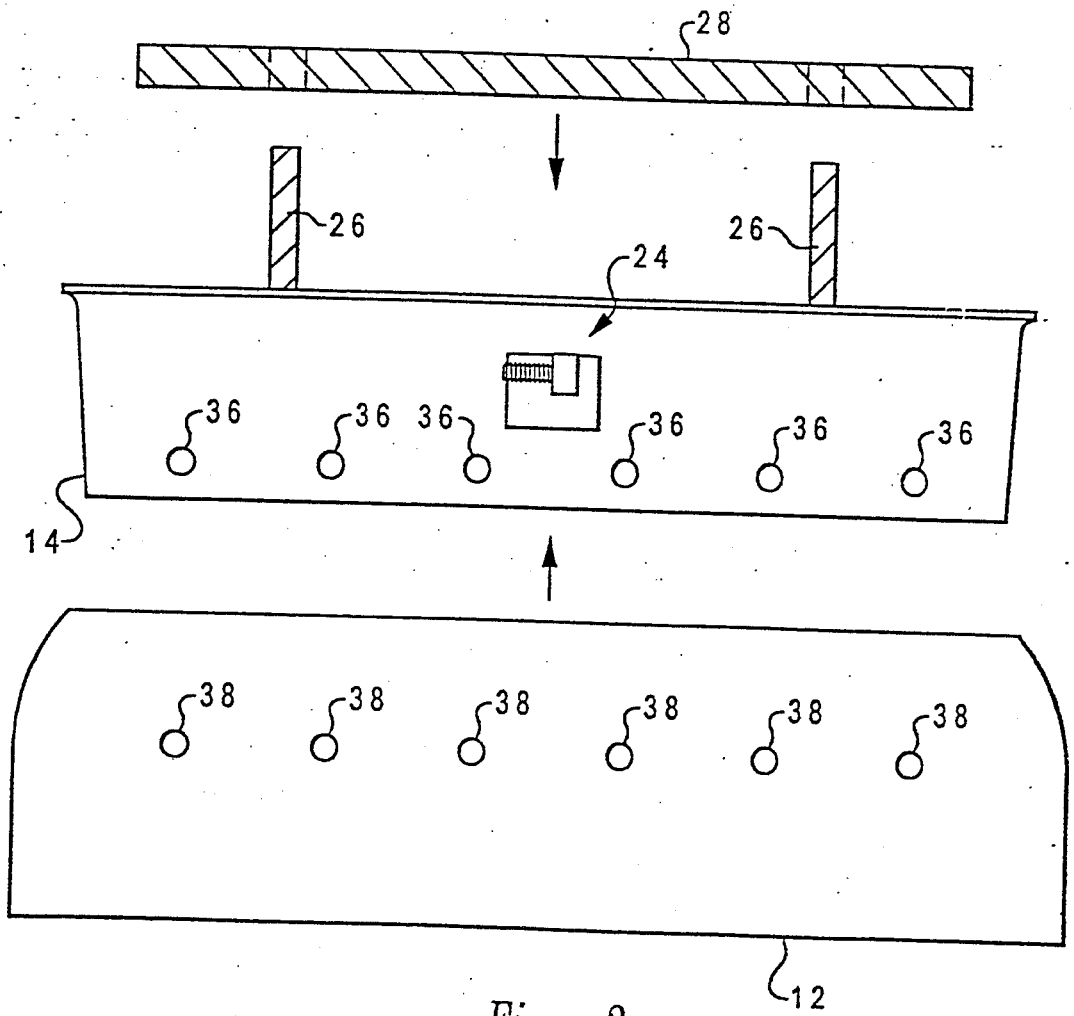
FIG. 2 is an exploded view of a blade housing showing the attachment of weights and a spreader blade.

Referring to FIG. 2, the blade housing 14 has a plurality of holes 36 through both sides. These correspond to matching holes 38 in the blade 12. The blade 12 is slipped into the space between the two sides of the housing 14, and affixed firmly in place using bolts projecting through the holes 36 and 38 and nuts (not shown) holding them in place.

The weights 28 have holes (not shown in FIG. 2) corresponding to the positions of the support rods 26. This allows them to simply be stacked onto the top of the housing 14 and held in place by the rods 26. If desired, some type of cap, (not shown) can be placed over the ends of the supporting rods 26 in order to maintain the weights 28 in position. However, because the rods 26 will be approximately vertical during normal use, the weights will generally stay in place of their own accord.

Figure 3:
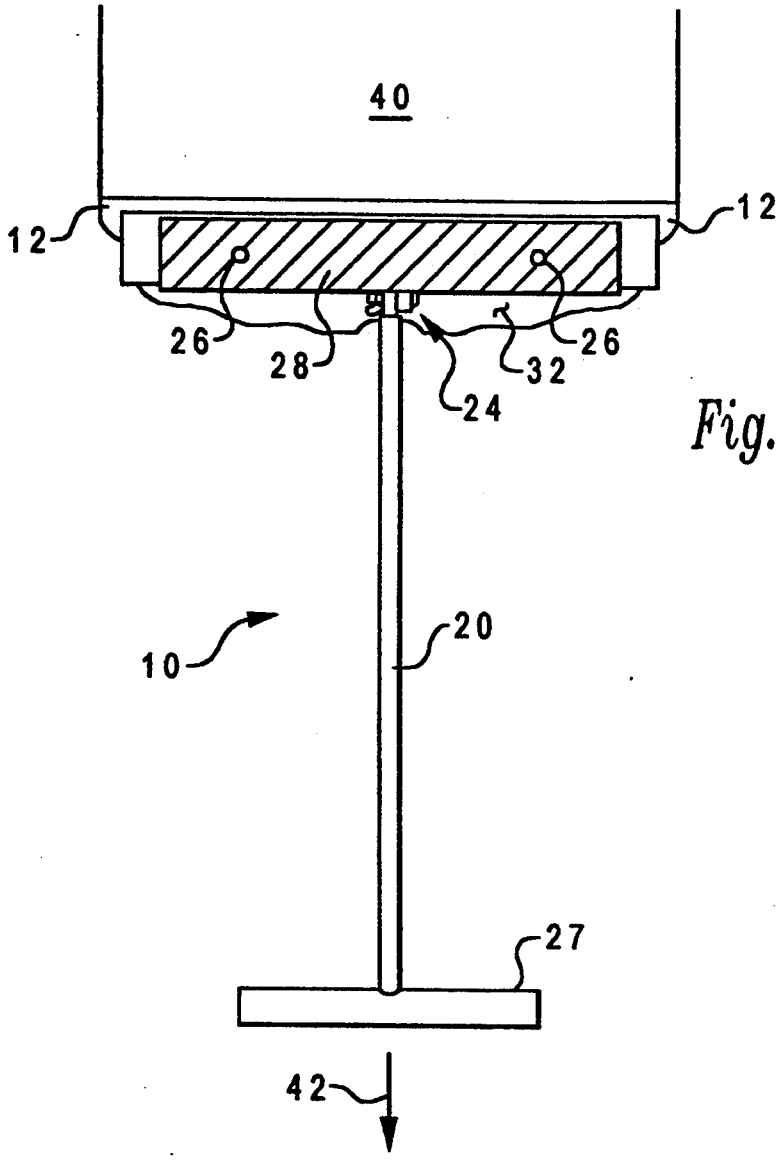
FIGS. 3 is a top view of the preferred spreader illustrating its use to spread adhesive.

FIG. 3 illustrates operation of the spreader from a top view. When the spreader is pulled in the direction of arrow 42, adhesive 32 tends to build up in the front of the blade 12. The weight of the weights 28, in addition to that of the blade 12 and blade housings 14 themselves, causes a thin layer of adhesive 40 to be spread over the surface. As described above, the thickness of this layer 40 is a function of the weight applied to the housing, the viscosity of the adhesive 32, and the speed with which the spreader 10 is pulled.

Figure 4:
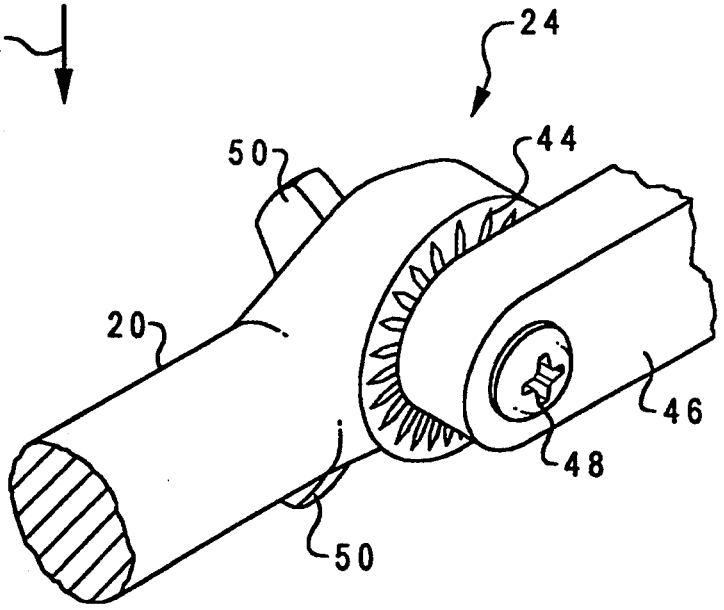
FIG. 4 illustrates one technique for attaching a handle to a blade housing.

Referring to FIG. 4, a detailed view is shown of a preferred connector 24 for attaching the handle 20 to the blade housing. The handle 20 contains a plurality of radially positioned ribs on one surface. Corresponding radial ribs (not shown) are formed on the extension arm 46 which is connected to the blade housing 14. A bolt 48 projects through the extension arm 46, and through a corresponding hole in the handle 20 in the center of the radial ribs 44. A wing nut 50 is then tightened to press the handle 20 firmly against the extension arm 46. These two components will remain in a rigid position relative to each other as a result of the radial ribs 44.

It will be appreciated by those skilled in the art that various modifications may be made to the preferred embodiment described in detail above. For example, various types of handles may be used, and any suitable means for connecting the handle to the blade housing will result in a functional device. The blade 12 can be attached to the housing 14 using any suitable clamping or attaching means. In addition, the detachable weights 28 may be attached to the housing 14 using any suitable mechanism. Although the provision of holes in the weights, corresponding to rods on the housing, is not the only technique for attaching the weights to the housing, such an approach has the obvious virtues of extreme simplicity and ease of use.

The general concept of the invention as described above may be used in many ways. For example, detachable weights have been described as the preferred embodiment, and have the advantage that a single unit can be used with various adhesive thicknesses by simply varying the weight on the blade. In a simpler version, the blade housing can simply be made much heavier than is normally the case. The housing is made heavy enough that separate weights need not be attached. The weight transmitted to the blade comes from the weight of the housing rather than a component of vertical force applied by the user through the handle. Blade housings having different weights can be provided for use with adhesives having different viscosities, if desired.

The spreader described above is suitable for use in different sizes. For example, the blade 12 may be practically any useful width, with a width from 18 to 24 inches being especially suitable. The blade 12 is preferably formed from a metal which is thick enough to be fairly stiff, providing only a small amount of give in use. The housing, weights, and blade may be formed from any suitable materials such as are well known to those skilled in the art. For example, many of the components of the spreader may be formed of plastics. Various inexpensive metals may be used for durability and ease of cleaning.

It will be apparent to those skilled in the art that the spreader can be used by pushing it, rather than pulling. Although a pulling motion is believed to reduce operator fatigue and improve the spread of adhesive, pushing may be desirable or necessary in some cases. The described spreader can easily be used in the pushing configuration by simply adjusting the angle between the handle and the blade. The weight applied directly to the blade may need to be decreased, as there is a component of a downward force applied along the handle when the spreader is pushed.

Experimentation has proven that the described spreader, although it appears quite simple in concept, to provide substantial advantages over spreaders previously available. Because the weight applied in the vertical direction to the spreader blade 12 remains constant, being applied by the detachable weights 28 rather than a downward pressure of a user's arm, the thickness of the resulting adhesive layer is extremely uniform. Practice has shown that an individual spreading adhesive using this device can easily do in one hour what previously required six to eight hours, and the uniformity of the resulting adhesive layer is improved. This provides a tremendous labor saving in the application in floor utilizing a spread adhesive, greatly decreasing the cost of installing such floors.

While the invention has been particularly shown and described with reference to a preferred embodiment, it will be understood by those skilled in the art that various changes in form and detail may be made therein without departing from the spirit and scope of the invention.

What is claimed is:

1. An apparatus for spreading an adhesive on a surface, comprising:

a handle;

a blade housing attached to the handle, wherein said housing has an upper surface and two side surfaces extending downward therefrom, and wherein at least two pins project upward from the upper surface;

a blade placed between the two housing side surfaces and fixedly attached to both of the side surfaces so that a lower edge thereof projects below said housing to make contact with the surface, wherein said blade is held at an angle such that only the lower edge contacts the surface; and at least one weight attached to said housing for generating a downward force through said blade, wherein said weight has at least two holes corresponding to positions of the pins, and wherein said weight rests upon the upper surface and is held in position so that force due to said weight is transmitted through said blade, and to the surface through the lower edge of said blade.

2. The apparatus of claim 1, wherein said blade is detachable from said blade housing.

3. The apparatus of claim 1, further comprising means for adjusting an angle between said handle and said blade housing.

4. The apparatus of claim 1, wherein said at least one weight has a mass large enough to generate a downward force through the blade sufficient to cause adhesive spread by the apparatus to spread thinly over the surface without the application of a component of vertical force to said blade through said handle.

5. The apparatus of claim 4, wherein said at least one weight generates a downward force of between approximately 4 and 30 pounds.

* * * * *